US005857275A

United States Patent [19]

Deal

[11] Patent Number: 5,857,275

[45] Date of Patent: Jan. 12, 1999

[54] LABEL WITH ENHANCED GRIP

[76] Inventor: Richard E. Deal, 614 S. Moore, Algona, Iowa 50511

[21] Appl. No.: 518,957

[22] Filed: Aug. 24, 1995

Related U.S. Application Data

[63] Continuation of Ser. No. 269,915, Jun. 30, 1994, abandoned.

[51] Int. Cl.[6] ..... G09F 3/08

[52] U.S. Cl. ..... 40/310; D9/556

[58] Field of Search ..... 40/306, 310; D9/502, D9/516, 537, 556; 215/1 C; 220/672, 674, 906

[56] References Cited

U.S. PATENT DOCUMENTS

| | | | |
|---|---|---|---|
| D. 95,035 | 4/1935 | Gayner . | |
| D. 240,968 | 8/1976 | Hurst . | |
| D. 253,809 | 1/1980 | Hartung . | |
| D. 294,120 | 2/1988 | Griesing et al. . | |
| D. 295,375 | 4/1988 | Lang . | |
| D. 312,398 | 11/1990 | Neto . | |
| D. 313,177 | 12/1990 | Larson . | |
| D. 316,965 | 5/1991 | Arvidson et al. . | |
| D. 322,213 | 12/1991 | Maginnis, Jr. | D9/317 |
| D. 327,219 | 6/1992 | Hestehave et al. | D9/530 |
| D. 332,406 | 1/1993 | Desgrippes et al. | D9/570 |
| D. 337,273 | 7/1993 | Thatcher | D9/539 |
| D. 344,457 | 2/1994 | Prevot et al. | D9/537 |
| 496,554 | 5/1893 | Duesbury | 40/310 X |
| 1,032,610 | 7/1912 | Kern | 40/310 X |
| 1,464,347 | 8/1923 | Avenson et al. | 40/310 X |
| 2,051,665 | 8/1936 | West | 40/310 |
| 2,905,350 | 9/1959 | Edwards . | |
| 3,372,830 | 3/1968 | Edwards . | |
| 4,308,955 | 1/1982 | Schieser et al. . | |
| 4,610,366 | 9/1986 | Estes et al. | 215/1 C |
| 4,802,295 | 2/1989 | Darr | 40/310 |
| 4,804,097 | 2/1989 | Alberghini et al. | 215/1 C X |
| 5,148,930 | 9/1992 | Ota et al. . | |
| 5,337,909 | 8/1994 | Vailliencourt | 40/310 X |

*Primary Examiner*—Joanne Silbermann
*Attorney, Agent, or Firm*—Zarley, McKee, Thomte, Voorhees & Sease

[57] ABSTRACT

An improved label is provided for enhancing the grip of bottles, cans and other objects held with a person's hand or fingers. The label includes a panel member applied to the object over a plurality of beads, so as form raised portions in the label which enhance gripping of the object. The beads are spaced apart and extend substantially horizontally. The beads preferably have a geometric cross sectional shape. The label engages the object between adjacent beads. In an alternate embodiment, the raised portion of the label is formed by a series of horizontal folds which increase the thickness of the label to provide a rib or ridge in the label for enhanced gripping.

14 Claims, 2 Drawing Sheets

LABEL WITH ENHANCED GRIP

This is a continuation of application Ser. No. 08/269,915 filed on Jun. 30, 1994, now abandoned.

BACKGROUND OF THE INVENTION

Bottles and cans of numerous sizes and shapes have been known for many years for drinks such as pop, beer, juice and water. Common beverage containers currently used by manufacturers are a 12 ounce glass bottle or aluminum can, and plastic liter bottles.

In drinking from the conventional 12 ounce beverage containers, one problem is that the can or bottle, generally containing a chilled liquid, has a tendency to acquire condensation on the cylindrical side wall of the container which may make the container slippery and difficult to handle.

Another problem with the conventional 12 ounce and liter beverage containers is the grasping of the container by children or adults with small hands can be difficult. Also, people with physical impairment of the hands, such as arthritis, often times have difficulty gripping a smooth cylindrical bottle or can.

Other objects also may present gripping problems for the user. For example, writing utensils, such as pens, often have a smooth, slick gripping portion or may become slippery due to perspiration of the hand. Other bottles used in wet environments, such as shampoo bottles and dish detergent bottles also may become more difficult to grasp due to moisture on the bottle or user's hands.

Therefore, a primary objective of the present invention is the provision of an improved label with an enhanced grip for use on bottles, cans, and other objects to be gripped with a person's hand or fingers.

Another objective of the present invention is the provision of a label for bottles, cans, and other containers having a plurality of raised ribs or ridges for enhanced gripping A further objective of the present invention is the provision of a label having a plurality of beads which enhance the grip of the bottle, can or object to which the label is applied.

Still another objective of the present invention is the provision of a method for enhancing the grip of objects, such as cans and bottles, by providing at least one raised portion on the label of the object.

A further objective of the present invention is the provision of an improved grippable label which is economical to manufacture and durable in use.

These and other objectives will become apparent from the following description of the invention.

SUMMARY OF THE INVENTION

The improved label of the present invention is adapted for use with bottles, cans, and other containers or objects which are intended to be gripped or held in a person's hand or fingers. The improved label includes a paper or plastic panel member adapted to be applied to the object or container for conventional purposes, such as identification, information, instructions, or advertising. A plurality of beads are placed beneath the panel member adjacent the exterior surface of the object or container so as to provide raised portions on the label. The beads are spaced apart and extend substantially horizontally. The beads have a geometric shape in cross section. The panel member engages the object or container between adjacent beads. In an alternative embodiment, the panel member of the label includes a plurality of folds which form the raised portion of the label.

The method of enhancing the grip on an object or container, according to the present invention, includes the steps of placing one or more beads adjacent the exterior surface of the object, and applying a label over the beads in adherence with the object or container, so as to provide a ribbed label surface.

DETAILED DESCRIPTION OF THE DRAWINGS

Figure 1:
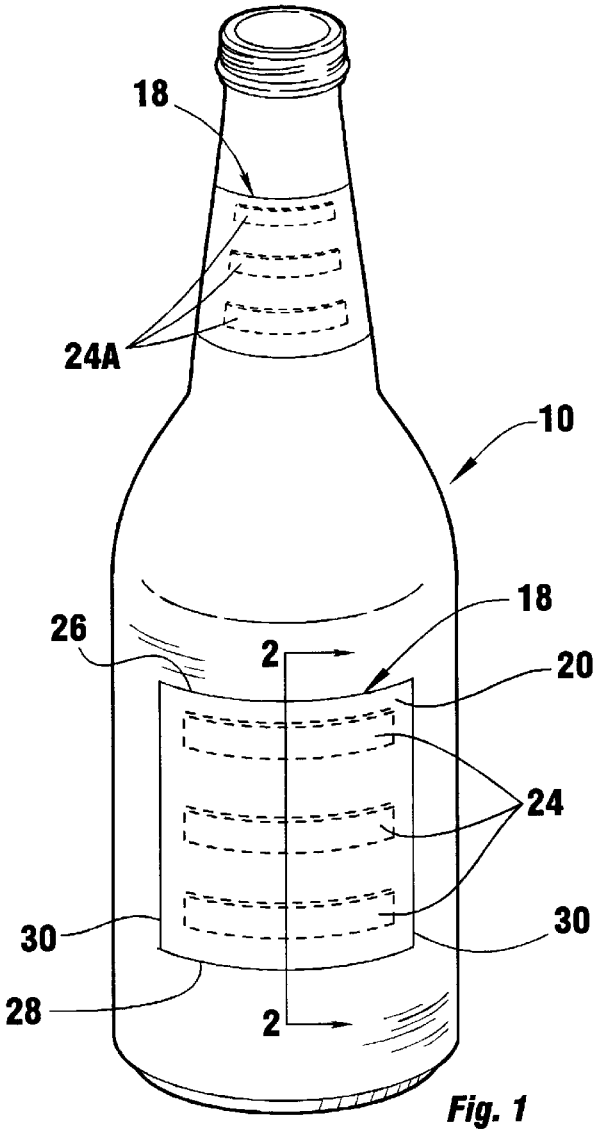
FIG. 1 is a perspective view of a bottle having an improved label according to the present invention.

With reference to the drawings, a bottle is generally designated by the reference numeral 10. The bottle includes a body 12 and a neck 14, with a top opening 16 from which the contents of the bottle can be poured. The bottle is conventional, and does not constitute a part of the present invention.

Figure 2:
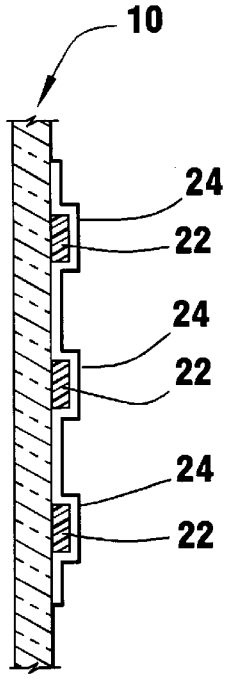
FIG. 2 is a sectional view taken along lines 2—2 of FIG. 1.

The present invention is directed towards a label 18 which is applied to the bottle 10 so as to provide enhanced gripping of the bottle. The label 18 includes a paper or plastic panel member 20 which is adhered to the bottle over a plurality of beads or cords 22. The panel member 20 extends over the beads 22 and engages the bottle on opposite sides of each bead 22 so as to form a plurality of raised ridges or ribs 24, as best seen in FIG. 2. The raised portions formed by the ribs 24 provide for enhanced gripping of the bottle 10.

Figures 3, 4, 5, 6:
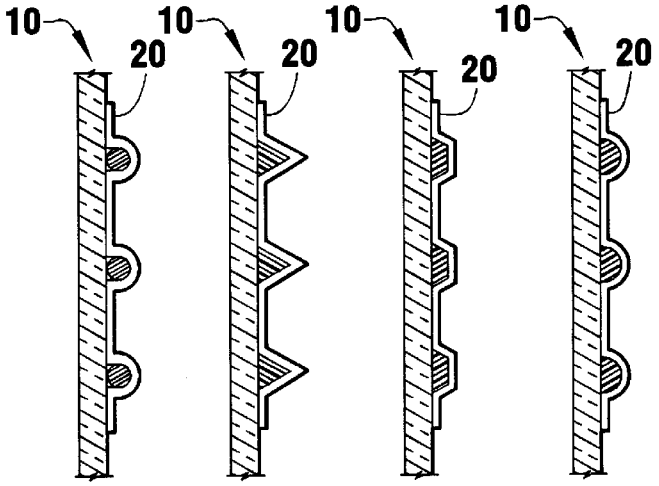
FIGS. 3–6 are sectional views similar to FIG. 2 showing alternative embodiments of the improved label of the present invention.

As seen in FIG. 2, the beads 22 have a rectangular cross sectional shape. The beads 22 may have other shapes so as to provide raised portions in the panel member extending over the beads. FIGS. 3–6 show alternative embodiments of the cross sectional shape of the beads 22. More particularly, in FIG. 3, the beads are shown to be round; FIG. 4 shows the beads to be triangular; FIG. 5 shows the beads to be trapezoidal; and FIG. 6 shows the beads to be semi-circular in cross section. Preferably, the beads are elongated and extend substantially horizontally when the bottle 10 is oriented in an upright position, as shown in FIG. 1. The beads may be made of any suitable material, such as plastic, paper, or cardboard. Also, the opposite ends of the beads may be tapered to provide for a smooth transition in the panel member between the bottle and the bead ends.

In FIG. 1, the label 18 is shown to be positioned on a front portion of the bottle 10. The panel member 20 includes a top edge 26, a bottom edge 28, and opposite side edges 30. The beads 24 reside within the perimeter edges of the panel member 20. A similar label 18A having a plurality of raised portions 24A formed by beads may also be used on the neck 14 of the bottle 10, as shown in FIG. 1. Due to the smaller circumference of the neck of the bottle, as compared to the circumference of the body of the bottle, the label 18A may extend 360° around the bottle neck 14.

Figure 7:
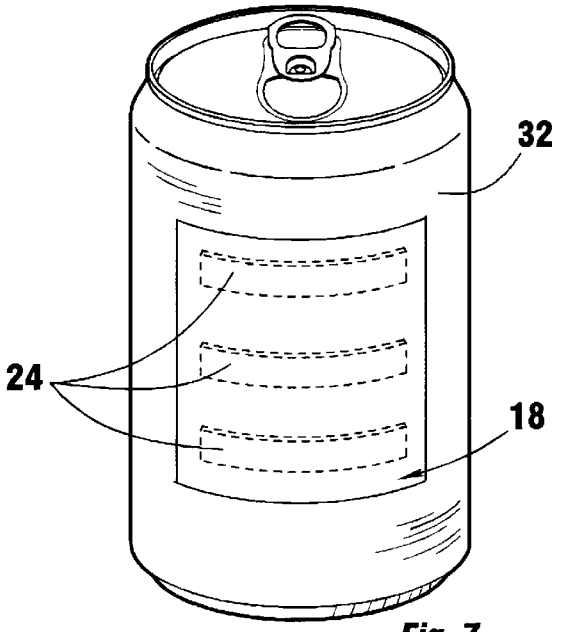
FIG. 7 is a perspective view showing a beverage can having the improved label of the present invention.

In FIG. 7, the label 18 is applied to a beverage can 32.

Figure 8:
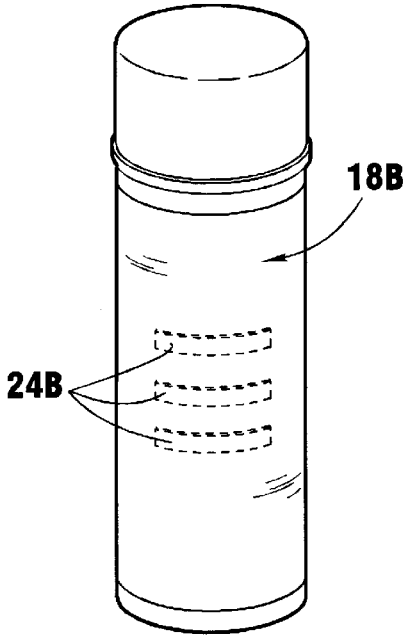
FIG. 8 is a perspective view of an aerosol can having the improved label of the present invention.

A similar label 18B is shown in FIG. 8, as applied to an aerosol can. In FIG. 8, the label 18B is substantially identical to the label 18, except that the label 18B extends at least 360° around the aerosol can 34.

Figure 9:
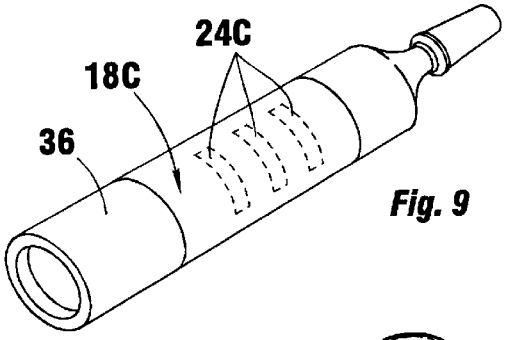
FIG. 9 is a perspective view of a marking pen having the improved label of the present invention.

In FIG. 9, a similar label 18C having raised portions 24C is shown applied to a marking pen 36. The raised portions 24C on the pen 36 provide an enhanced grip for the user of the pen.

Thus, each of the labels 18, 18A, 18B, and 18C provide a method of enhancing the grip on an object or container. The method includes the steps of placing at least one bead adjacent the surface of the object or container, and applying the panel member of the label over the bead and onto the surface of the object so as to provide a ribbed or ridged label surface. The label is adhered or otherwise secured to the object.

Figure 10:
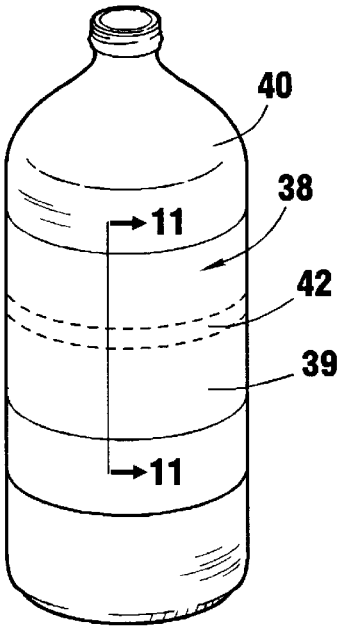
FIG. 10 is a perspective view of a bottle having an alternative embodiment of an improved label, in accordance with the present invention.
Figure 11:
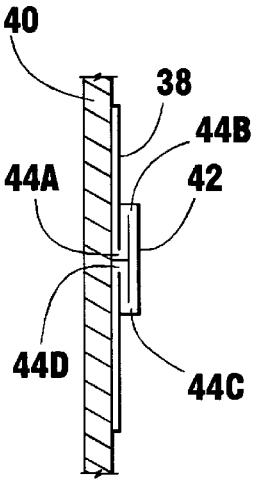
FIG. 11 is a sectional view taken along lines 11—11 of FIG. 10.

FIGS. 10 and 11 show an alternate embodiment of an improved label 38 of the present invention, as used on a liter bottle 40. The label 38 includes a panel 39 which is provided on the bottle 40 and has at least one raised portion 42. The raised portion 42 of the label 38 is formed by a plurality of folds in the label, as seen in FIG. 11. More particularly, a series of four folds 44A, 44B, 44C, and 44D form a triple-thickness of the panel material. The folds extend substantially horizontally so as to form a horizontal rib or ridge in the panel member 39. The label can be further folded accordion-style so as to provide an even thicker raised portion. The raised portion 42 provides for an enhanced gripping of the bottle 40. The label 38 can be used on other objects, such as the bottles and cans shown in FIGS. 1, 7 and 8.

As seen in the drawings and described above, the improved gripping label of the present invention can be used on numerous types of objects which are gripped with a person's hand or fingers, such as cans, bottles, marking pens, and the like. The label can extend partially or fully around any portion of the object which is normally gripped with the person's hand or fingers Whereas the invention has been shown and described in connection with the preferred embodiments thereof, it will be understood that many modifications, substitutions, and additions may be made which are within the intended broad scope of the following claims.

For example, the beads may be sandwiched between a pair of panel members, with the back panel member being adhered to the bottle or can. The beads may also be applied over an existing label with adhesive or tape. Also, for the purpose of packaging multiple bottles or cans, the beads or raised portions of the labels may be offset vertically or laterally from one bottle or can to the adjacent bottle or can, so that the beads or raised portions on adjacent bottles or cans do not engage one another, or nest with respect to one another.

From the foregoing, it can be seen that the present invention accomplishes at least all of the stated objectives.

What is claimed is:

1. A method of enhancing the grip on an object, the object having a smooth exterior surface, comprising:

placing a plurality of horizontally oriented and vertically spaced solid beads adjacent the smooth exterior surface of the object; and applying a label over the beads and to the object so as to provide a horizontally ribbed label surface raised above the smooth exterior surface.

2. The method of claim 1 wherein the label engages the smooth exterior surface of the object between adjacent beads.

3. In combination with cans and bottles having a smooth exterior surface, an improved label comprising:

a panel member applied to the smooth exterior surface of a can or bottle, and having a top edge, a bottom edge, and opposite side edges; and a plurality of elongated raised portions between the top and bottom edges of the panel member, the portions being formed by at least one of a plurality of beads positioned adjacent to the smooth exterior surface of the can or bottle and beneath the panel member to provide enhanced gripping of the can or bottle;

the beads being formed separately from the bottle or can and panel member.

4. The combination of claim 3 wherein the raised portion are each is formed with a bead solid between the panel member and the smooth exterior surface of the can or bottle.

5. The combination of claim 4 wherein the beads have a cross sectional geometric shape.

6. The combination of claim 3 wherein the raised portions are vertically spaced apart and extend substantially horizontally.

7. A container adapted to be gripped in a person's hand, the container having a smooth exterior surface and a label, the label comprising:

a panel member adapted to be applied to a container; and a plurality of elongated solid beads adapted to be positioned between the panel member and the smooth exterior surface of the container in substantially horizontal and vertically spaced orientations to provide a raised surface for enhanced gripping of the container;

the panel member engaging the container between adjacent beads.

8. The container of claim 7 wherein the beads are made of non-particulate material.

9. The container of claim 7 wherein the beads are formed separately from the container.

10. The combination of claim 7 wherein the beads have structural integrity apart from the bottle or can and panel member.

11. A container adapted to be gripped in a person's hand, the container having a smooth exterior surface and a label, the label comprising:

a panel member adapted to be applied to a container; and a plurality of elongated solid beads adapted to be positioned between the panel member and the smooth exterior surface of the container in substantially horizontal and vertically spaced orientations to provide a raised surface for enhanced gripping of the container;

the beads being made of paper or plastic.

12. A container adapted to be gripped in a person's hand, the container having a smooth exterior surface and a label, the label comprising:

a panel member adapted to be applied to a container; and a plurality of elongated solid beads adapted to be positioned between the panel member and the smooth exterior surface of the container in substantially horizontally and vertically spaced orientations to provide a raised surface for enhanced gripping of the container;

the beads having a rear surface engagable with the exterior surface of the container.

13. The container of claim 12 wherein the bead has a geometric shape in cross section.

14. The container of claim 12 wherein the panel member partially surrounds the beads.

* * * * *